US012752179B1

(12) United States Patent
Aurah et al.

(10) Patent No.: US 12,752,179 B1
(45) Date of Patent: Oct. 6, 2026

(54) CUE TIP SYSTEM AND METHOD OF USE

(71) Applicants: Lion Aurah, Desoto, TX (US); Deryck Gildon, Arlington, TX (US)

(72) Inventors: Lion Aurah, Desoto, TX (US); Deryck Gildon, Arlington, TX (US)

( * ) Notice: Subject to any disclaimer, the term of this patent is extended or adjusted under 35 U.S.C. 154(b) by 797 days.

(21) Appl. No.: 18/146,170

(22) Filed: Dec. 23, 2022

Related U.S. Application Data

(63) Continuation-in-part of application No. 17/974,304, filed on Oct. 26, 2022.

(51) Int. Cl.
*A63D 15/12* (2006.01)

(52) U.S. Cl.
CPC ..... *A63D 15/12* (2013.01)

(58) Field of Classification Search
CPC ..... A63D 15/12
USPC ..... 473/49
See application file for complete search history.

(56) References Cited

U.S. PATENT DOCUMENTS

| | | | | | |
|---|---|---|---|---|---|
| 1,033,071 | A * | 7/1912 | Duc | A63D 15/12 | 473/49 |
| 1,201,677 | A * | 10/1916 | Bechle | A63D 15/12 | 473/49 |
| 1,314,347 | A * | 8/1919 | Mikula | A63D 15/12 | 473/49 |
| 3,580,576 | A * | 5/1971 | Merola | A63D 15/12 | 473/49 |
| 5,725,437 | A * | 3/1998 | McCarty | A63D 15/12 | 473/49 |
| 7,549,928 | B1 * | 6/2009 | Lickfold | A63D 15/12 | 473/49 |
| 2003/0166419 | A1 * | 9/2003 | Gulyassy | A63D 15/12 | 473/44 |

* cited by examiner

*Primary Examiner* — Michael D Dennis
(74) *Attorney, Agent, or Firm* — Avek IP, LLC

(57) ABSTRACT

A pool cue includes a shaft extending from a first end to a second end; a tip attached to the shaft at the first end, the tip having a laminated tip having a bottom portion; and an acrylic pad having a pocket to receive the bottom portion of the laminated tip; the acrylic pad attaches the tip to the shaft; and the laminated tip is configured to strike a cue ball.

9 Claims, 4 Drawing Sheets

CUE TIP SYSTEM AND METHOD OF USE

RELATED APPLICATIONS

This application is a continuation-in-part of and claims priority to U.S. application Ser. No. 17/974,304, filed Oct. 26, 2022, which is incorporated by reference in its entirety herein.

FIELD OF THE DISCLOSURE

The present invention relates generally to gaming systems and methods, and more specifically, to a cue tip system that provides a control tip to a pool cue through the use of a conical contact surface where the tip interacts with a pool ball so that control over the motion of the ball is increased.

DESCRIPTION OF RELATED ART

Gaming systems are well known in the art and are effective means to create rules and environments where people compete against each other or against themselves for entertainment, adventure, and cultural development. Common gaming systems include pool, where a set of balls are placed on a felt surface or table. A pool cue which is a shaft with a padded end is used to hit the cue ball so that it contacts other balls so that they fall into holes. The cue is used to create many types of strikes on the cue ball to enable different motions in it. Commonly, a 'sweet spot' exists on the cue ball that when hit produces a strong movement in the cue ball. Commonly this 'sweet spot' is located in the center of the cue ball and the intent is to transfer energy from the cue to the cue ball. The contact area between the cue and cue ball directly affects the transfer of energy between the two.

One of the problems associated with common pool cue systems is their limited efficiency. For example, a felt tip is commonly used on a pool cue and when it contacts the cue ball it is on a small portion of the total felt area. The contact area could also not be the center of the felt and this misalignment reduces the effect of the strike on the cue ball. These issues result in loss of force applied to the cue ball by the pool cue and result in poor performance in the pool game.

BRIEF SUMMARY OF INVENTION

The following presents a simplified summary of the invention in order to provide a basic understanding of some aspects of the invention. This summary is not an extensive overview of the invention. It is not intended to identify critical elements of the invention or to delineate the scope of the invention. Its sole purpose is to present some concepts of the invention in a simplified form as a prelude to the more detailed description that is presented elsewhere.

A pool cue includes a shaft extending from a first end to a second end; a tip attached to the shaft at the first end, the tip having a laminated tip having a bottom portion; and an acrylic pad having a pocket to receive the bottom portion of the laminated tip; the acrylic pad attaches the tip to the shaft; and the laminated tip is configured to strike a cue ball.

BRIEF DESCRIPTION OF THE SEVERAL VIEWS OF THE DRAWINGS

Illustrative embodiments of the present disclosure are described in detail below with reference to the attached drawing figures.

Figure 1:
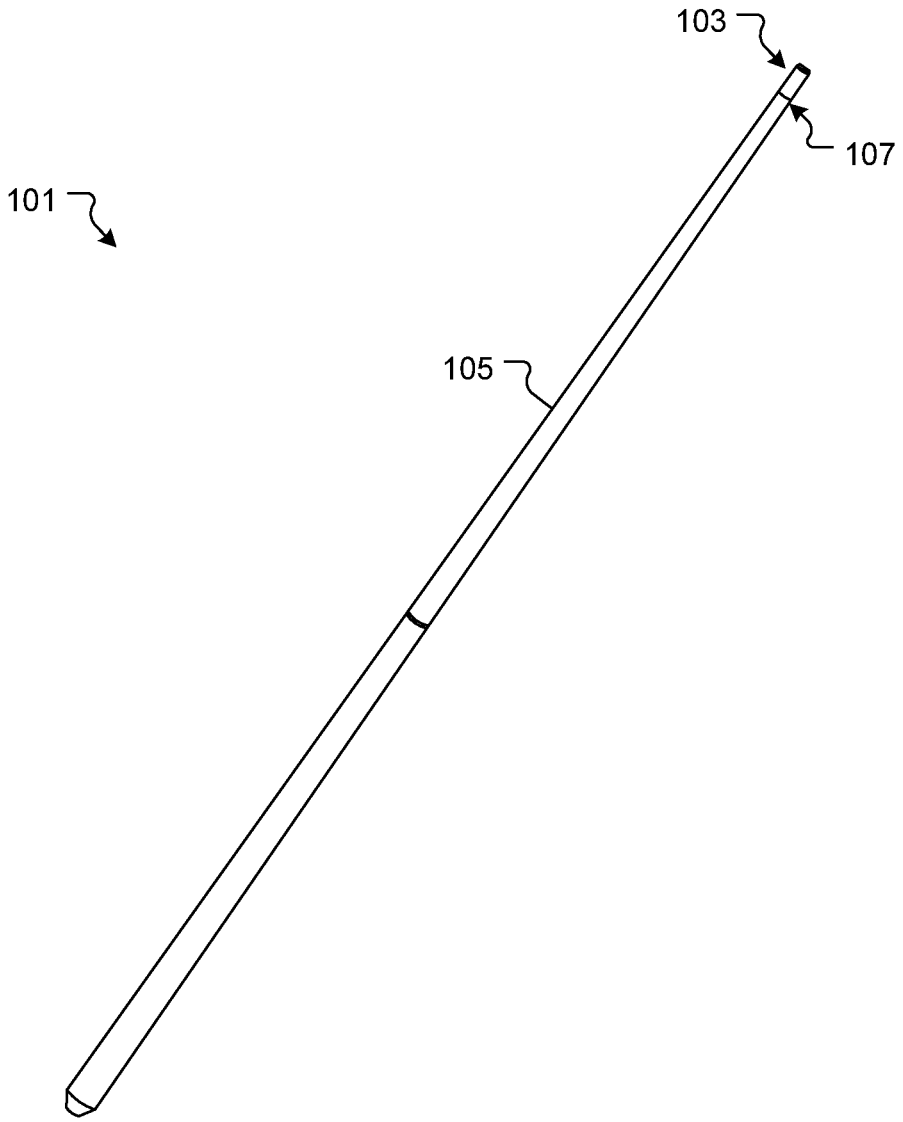
FIG. 1 is a front view of a cue tip system in accordance with an embodiment of the present application.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

The system and method of use in accordance with the present application overcomes one or more of the above-discussed problems commonly associated with conventional pool cue systems. Specifically, the present invention provides for a control tip to a pool cue to increase motion control of a cue ball. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Referring now to the drawings wherein like reference characters identify corresponding or similar elements throughout the several views, FIG. 1 depicts a front view of a cue tip system in accordance with a preferred embodiment of the present application. It will be appreciated that system 101 overcomes one or more of the above-listed problems commonly associated with conventional gaming systems and pool cue systems.

In the contemplated embodiment, system 101 includes a shaft 105 with a tip 103 attached at one end 107 thereof. The user may utilize the shaft 105 to control operation of the tip 103.

Figure 2A:
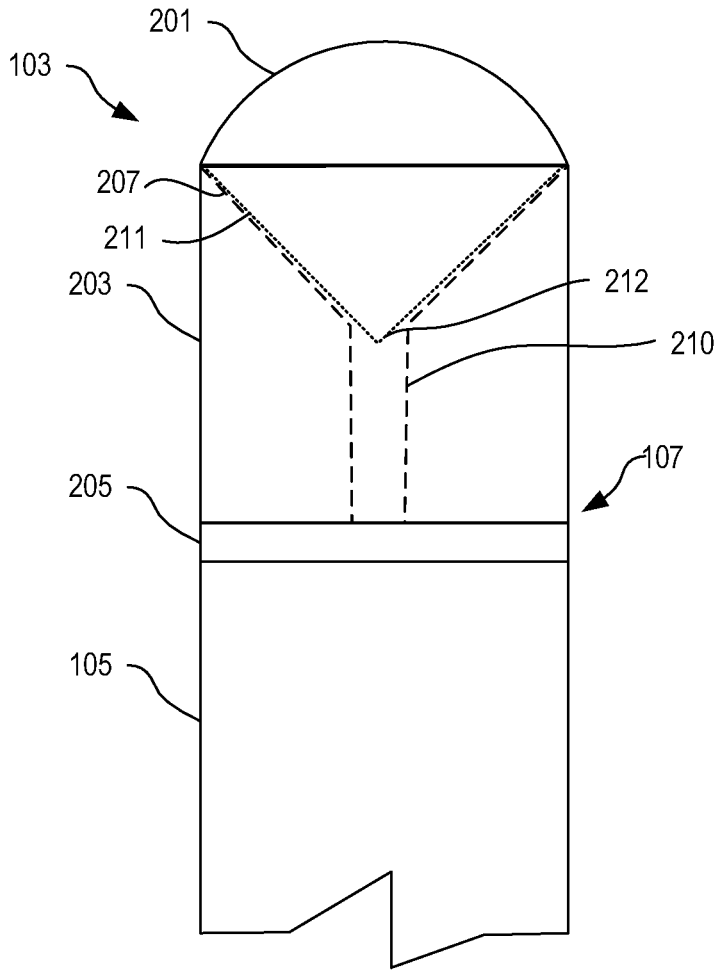
FIGS. 2A and 2B are front views of the tip of FIG. 1 shown in an assembled and deconstructed configuration respectively.
Figure 2B:
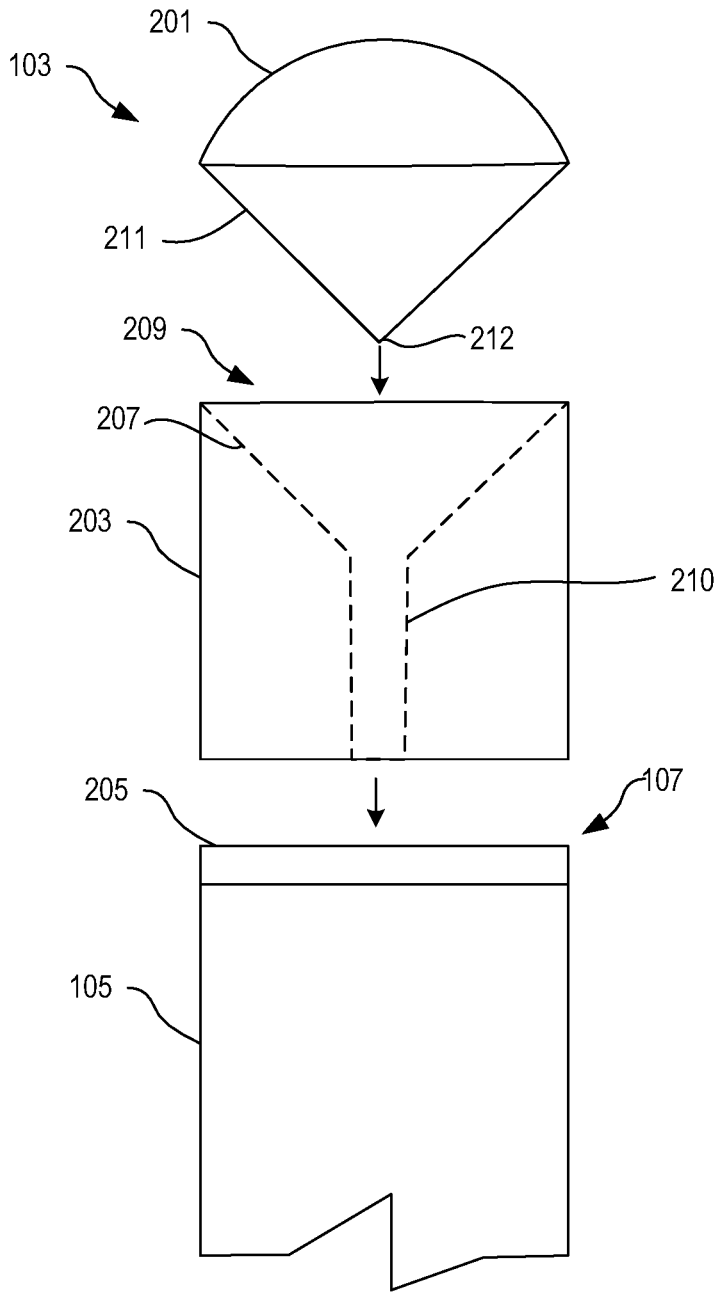

Referring now to FIGS. 2A and 2B, tip 103 is further depicted and includes a laminated tip 201 attached to an acrylic pad 203. Acrylic pad 203 is configured to attach to the ferrule 205 of the shaft 105. In embodiments, acrylic pad 203 has a conical pocket 207 extending from the top end 209 of the acrylic pad 203, the conical pocket 207 is configured to nest with a bottom portion 211 of laminated tip 201. As shown, in embodiments, the bottom portion 211 is further conical in shape, thereby creating a secure fit within conical pocket 207. In embodiments, a hole 210 extends from a bottom of conical pocket 207 and through a center area of acrylic pad 203. A bottom point 212 of the bottom portion 211 may extend slightly into the hole 210 as shown.

It should be appreciated that one of the unique features believed characteristic of the present invention is the conical connection between the acrylic pad 203 and the laminated tip 201, and further the hole 210 which is integral with the conical pocket 207. This combination of features allows for energy from striking a ball to transfer from the laminated tip 201, through the bottom portion 211, and then into hole 210, wherein the hole 210 serves as a weak spot to absorb the energy. This prevents the energy from being pushed or otherwise forced in an undesirable direction. This feature allows for improved control when using system 101.

In the preferred embodiment, laminated tip 201 and acrylic pad 203 are trimmed to match the diameter of shaft 105. When trimmed, laminated tip 201 is attached to acrylic pad 203 via a glue or another bonding agent. In addition, in embodiments, the acrylic material in the acrylic pad 203 is white.

In use, tip 103 is attached to a pool cue and used to strike a cue ball. Laminated tip 201 deforms and conforms to the surface of the cue ball, in a concave fashion, so that a greater portion of tip 103 contacts the cue ball and improves the motion of the cue ball that results from the strike by the pool cue with tip 103.

It should be appreciated that one of the unique features believed characteristic of the present application is that acrylic pad 203 allows laminated tip 201 to deform and contour to the cue ball.

Figure 3:
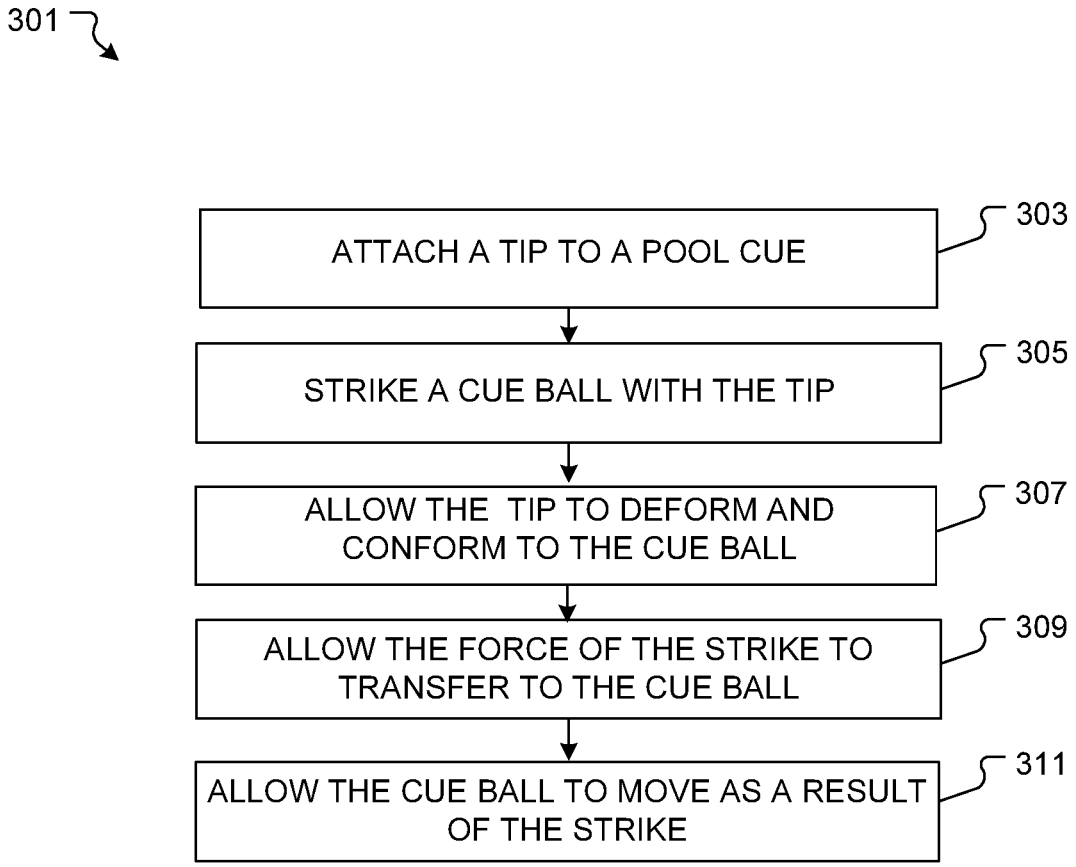
FIG. 3 is a flowchart of a method of striking a cue ball.

Referring now to FIG. 3, a method of striking a cue ball is depicted. Method 301 includes attaching a tip to a pool cue 303, striking a cue ball with the tip 305, allowing the tip to deform and conform to the surface of the cue ball 307, in a concave fashion, allowing the force of the strike to transfer to the cue ball 309, and allowing the cue ball to move as a result of the strike 311. During use, energy is transferred through the hole 210 and into the shaft, such that optimal control is provided to the user.

Many different arrangements of the various components depicted, as well as components not shown, are possible without departing from the spirit and scope of the present disclosure. Embodiments of the present disclosure have been described with the intent to be illustrative rather than restrictive. Alternative embodiments will become apparent to those skilled in the art that do not depart from its scope. A skilled artisan may develop alternative means of implementing the aforementioned improvements without departing from the scope of the present disclosure.

What is claimed is:

1. A pool cue, comprising:

a shaft extending from a first end to a second end;

a tip attached to the shaft at the first end, the tip having:

a laminated tip having a top portion and a bottom portion, the top portion being a dome, the dome terminating at an interface between the top portion and the bottom portion, the bottom portion extending from the interface to a lowermost point of the laminated tip, wherein the bottom portion tapers continuously from the interface to the lowermost point;

an acrylic pad extending from a top end to a bottom end and having a pocket extending inward from the top end, the pocket to receive the bottom portion of the laminated tip; and a hole extending at least partially through the acrylic pad, the hole originating from the pocket and the pocket terminating at the hole;

wherein the bottom portion of the laminated tip is secured within the pocket via an adhesive;

wherein the bottom portion of the laminated tip is secured within the pocket such that the interface between the bottom portion and the top portion is flush with the top end of the acrylic pad such that only the dome extends from the acrylic pad; and wherein, when the laminated tip is adhered within the pocket, the lowermost point of the laminated tip interfaces with the hole such that no portion of the lowermost point interfaces with the acrylic pad;

wherein a bottom most surface of the acrylic pad attaches the tip to the shaft, the bottom most surface securing in a flat planar configuration against a flat top surface of the shaft;

wherein the laminated tip does not come into contact with a wall forming the hole; and wherein the laminated tip is configured to strike a cue ball such that energy from said strike is directed through the laminated tip and into the hole.

2. The pool cue of claim 1, wherein the bottom portion is conical in shape.

3. The pool cue of claim 1, wherein the tip further comprises the hole extending through a center of the acrylic pad, the hole receiving the lowermost point of the bottom portion of the laminated tip.

4. The pool cue of claim 1, wherein the acrylic pad is solid other than the pocket and the hole.

5. The pool cue of claim 1, wherein the bottom most surface of the acrylic pad is solid and within a single plane.

6. The pool cue of claim 2, wherein the bottom portion is defined by a width that decreases continuously from the interface to the lower most point of the laminated tip.

7. The pool cue of claim 1, wherein the hole is open only to the pocket.

8. The pool cue of claim 1, wherein the hole extends coaxially with a center line of the shaft and the tip, the hole being inaccessible from an exterior of the shaft and the tip when secured together.

9. A pool cue, consisting of:

a shaft extending from a first end to a second end;

a tip attached to the shaft at the first end, the tip consisting of:

a laminated tip having a top portion and a bottom portion, the top portion being a dome, the dome terminating at an interface between the top portion and the bottom portion, the bottom portion extending from the interface to a lowermost point of the laminated tip, wherein the bottom portion tapers continuously from the interface to the lowermost point;

an acrylic pad extending from a top end to a bottom end and having a pocket extending inward from the top end, the pocket to receive the bottom portion of the laminated tip; and a hole extending from the pocket and the pocket terminating at the hole;

wherein the bottom portion of the laminated tip is secured within the pocket via an adhesive;

wherein the bottom portion of the laminated tip is secured within the pocket such that the interface between the bottom portion and the top portion is flush with the top end of the acrylic pad such that only the dome extends from the acrylic pad; and wherein, when the laminated tip is adhered within the pocket, the lowermost point of the laminated tip interfaces with the hole such that no portion of the lowermost point interfaces with the acrylic pad;

wherein a bottom most surface of the acrylic pad attaches the tip to the shaft, the bottom most surface securing in a flat planar configuration against a flat top surface of the shaft;

wherein the laminated tip does not come into contact with a wall forming the hole; and wherein the laminated tip is configured to strike a cue ball such that energy from said strike is directed through the laminated tip and into the hole.

* * * * *